US006679689B2

(12) United States Patent
Takahashi et al.

(10) Patent No.: US 6,679,689 B2
(45) Date of Patent: Jan. 20, 2004

(54) SCREW COMPRESSOR

(75) Inventors: Kazuki Takahashi, Tsuchiura (JP); Seiji Tsuru, Tsuchiura (JP); Minoru Taniyama, Ami (JP); Haruo Miura, Chiyoda (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/725,907

(22) Filed: Nov. 30, 2000

(65) Prior Publication Data

US 2002/0001531 A1 Jan. 3, 2002

(30) Foreign Application Priority Data

Jun. 30, 2000 (JP) ..... 2000-203050

(51) Int. Cl.[7] ..... F03C 2/00

(52) U.S. Cl. ..... 418/9; 418/83; 418/201.2; 417/243

(58) Field of Search ..... 418/9, 83, 201.2; 417/243

(56) References Cited

U.S. PATENT DOCUMENTS

| | | | | |
|---|---|---|---|---|
| 2,686,504 A | | 8/1954 | Hill | |
| 3,369,736 A | * | 2/1968 | Coleman | 417/372 |
| 3,644,054 A | * | 2/1972 | Pilarczyk | 417/375 |
| 3,765,386 A | | 10/1973 | Ottofy | |
| 4,174,196 A | | 11/1979 | Mori et al. | |
| 4,529,363 A | | 7/1985 | Suzuki | |
| 5,011,388 A | * | 4/1991 | Aoki et al. | 418/201.1 |
| 5,401,149 A | * | 3/1995 | Tsuru et al. | 418/178 |
| 5,613,843 A | * | 3/1997 | Tsuru et al. | 418/181 |

FOREIGN PATENT DOCUMENTS

| | | | | |
|---|---|---|---|---|
| EP | 0 587 157 A2 | | 3/1994 | |
| EP | 0 719 910 A1 | | 7/1996 | |
| EP | 0 761 974 A1 | | 3/1997 | |
| EP | 0 939 250 A2 | | 9/1999 | |
| JP | 59-005892 | * | 1/1984 | 418/9 |
| JP | 01-277696 | * | 11/1989 | 418/95 |
| JP | 02-301694 | * | 12/1990 | 418/178 |
| JP | 03-151592 | * | 6/1991 | 418/9 |
| JP | 6-101669 | | 4/1994 | |

* cited by examiner

*Primary Examiner*—Thomas Denion
*Assistant Examiner*—Theresa Trieu
(74) *Attorney, Agent, or Firm*—Crowell & Moring LLP

(57) ABSTRACT

A package-type screw compressor includes a low-pressure stage state compressor and a high-pressure stage compressor. Motive power is transmitted from an electric motor to the two compressors via a speed increaser. The discharge gas, compressed and heated to a high temperature by the low-pressure stage compressor, is cooled by an intercooler. The discharge gas, compressed and heated to a high temperature by the high-pressure stage compressor, is cooled by an aftercooler. A casing of the intercooler and that of the aftercooler are formed integrally with a speed increaser casing, reducing the number of component parts. A cooler portion, formed by the intercooler and the aftercooler, is spaced from the speed increaser casing, thereby preventing heat, produced by the compressed air, from being transmitted to the speed increaser casing.

9 Claims, 10 Drawing Sheets

SCREW COMPRESSOR

BACKGROUND OF THE INVENTION

This invention relates to a screw compressor, and more particularly to a screw compressor having two compressors, that is, a high-pressure stage compressor and a low-pressure stage compressor.

One conventional package-type screw compressor is disclosed in JP-A-6-101669. In the package-type screw compressor disclosed in this publication, compressors, a speed increasing gear and a main motor are mounted on a base in order to facilitate the inspection and maintenance operation and also to reduce an installation space, including a maintenance space to a minimum. An intercooler, an aftercooler, an oil cooler and a coolant cooler are arranged in a direction perpendicular to the axis of the motor so that tube nests of the air coolers can extend in the same direction. An operation panel with a maintenance display is provided on a front panel surface of a soundproof cover, and a door panel is of a double hinged type. With this construction, the daily inspection is carried out in a concentrated manner through the front panel surface and its adjoining side panel.

In the above conventional screw compressor, although the daily inspection of this screw compressor can be easily effected, the various equipments, forming the screw compressor, must be provided as separate units so as to be arranged for facilitating the maintenance, and as a result the number of the component parts are inevitably increased. Particularly, because the intercooler and the aftercooler are provided as the separate units and because there are needed pipes for connection of the compressors, forming the high-pressure stage and the lower-pressure stage, to the respective coolers, the number of the component parts naturally increases.

Further, in the package-type screw compressor, disclosed in the above publication, the air, compressed in the compressor body, is introduced into a cooling tube of each of the coolers, and the outer side of the cooling tube is cooled by cooling water. As a result, the coolers are increased in size although the cooling performance for the compressed air is enhanced. Therefore, there has been need for a package-type screw compressor in which each of coolers is made compact while maintaining the cooling performance at a currently-available level.

SUMMARY OF THE INVENTION

The present invention has been accomplished in view of the problems of the above conventional screw compressor, and it is an object of the invention to realize a screw compressor in which the number of component parts is reduced, thereby enhancing the assembling ability.

Another object of the invention is to realize a screw compressor which is compact and economical by reducing the number of the component parts.

A further object is to improve the maintenance ability of a screw compressor.

The invention seeks to attain at least one of these objects.

The first feature of the invention for attaining the objects is that, in a screw compressor comprising an electric motor having a bull gear mounted on an end of a shaft of the motor, a first stage compressor and a second stage compressor, each of which includes a male rotor with a pinion mounted on an end of its shaft and meshing with the bull gear, a speed increaser casing for accommodating the bull gear and the pinions, an intercooler for cooling the air compressed by the first stage compressor, and an aftercooler for cooling the air compressed by the second stage compressor, a casing of the intercooler, a casing of the aftercooler and the speed increaser casing are formed integrally with one another.

Preferably, the integral casing is made of a casting or molding, and the intercooler and the aftercooler have a cooler nest, and cooling water flows in a tube of the cooler nest while the compressed air flows outside of the tube; the integral casing has a generally L-shaped cross-section, the intercooler and the aftercooler are disposed adjacent to each other, and a space is formed for separating the two coolers and the speed increaser casing; flow passages, connecting the first and second stage compressors to the intercooler and the aftercooler, are formed in the integral casing; and the cooler nest is removably mounted on the integral casing, and the cooler nest can be removed in a direction substantially perpendicular to an axis of rotation of the motor.

Preferably, an oil tank portion for collecting lubricating oil for the pinions and the bull gear is formed at a lower portion of the speed increaser casing, and an oil pump for supplying the lubricating oil, collected in the oil tank portion, to the pinions and the bull gear, as well as an oil cooler for cooling the lubricating oil, is mounted on the speed increaser casing; a suction device for introducing gas from the interior of the speed increaser casing, and an oil-separating filter is provided between the speed increaser casing and the suction device; an ejector is provided for introducing gas from the interior of the speed increaser casing; and during the operation of the screw compressor, the interior of the speed increaser casing is kept at a pressure lower than the atmospheric pressure.

The second feature of the invention for attaining the objects is that, in a screw compressor comprising a first stage compressor, an intercooler for cooling working air compressed by the first stage compressor, a second stage compressor for compressing the working air cooled by the intercooler, and an aftercooler for cooling the compressed air compressed by the second stage compressor, in which a power of an electric motor is transmitted to the first and second stage compressor via speed increasing gears, an integral casing is provided, which together with the first and second stage compressors, includes all of working gas flow passages through which the working gas, drawn into the first stage compressor, flows out from the aftercooler.

Preferably, the integral casing includes a speed increaser casing for housing the speed increasing gears; the integral casing includes a casing of the intercooler and a casing of the aftercooler, and the intercooler and the aftercooler have a cooler nest, in which the working air flows outside of a tube of the cooler nest while cooing water flows in the tube; the integral casing includes a first stage discharge passage for connecting the first stage compressor to the intercooler, a second stage intake passage for connecting the intercooler to the second stage compressor, and a second stage discharge passage for connecting the second stage compressor to the aftercooler; an intake port for feeding the working air to the first stage compressor and a discharge port for feeding the working air, cooled by the aftercooler, to the consumer are formed in the integral casing; and the intercooler and the aftercooler are disposed adjacent to each other, and the two coolers are spaced from the speed increaser casing.

The third feature of the invention for attaining the above objects is that in a screw compressor comprising at least one stage compressor, a capacity control valve provided upstream of the first stage compressor, a check valve provided downstream of the final stage compressor, a blow-off valve capable of releasing discharge air, discharged from the final stage compressor, to the ambient atmosphere from a location between the final stage compressor and the check valve, and an aftercooler for cooling the discharge air discharged from the final stage compressor, a secondary side of the blow-off valve is connected to a primary side of the capacity control valve, and an integral casing is provided, which together with the first and second stage compressors, includes all of working gas flow passages through which the working gas, sucked into the first stage compressor, flows out from the aftercooler. Preferably, the blow-off valve is disposed between the aftercooler and the check valve; and the blow-off valve and the check valve are integrally incorporated in the capacity control valve.

BRIEF DESCRIPTION OF SEVERAL VIEWS OF THE DRAWINGS

FIGS. 6 to 10 show a speed increaser casing for use in the screw compressor of FIG. 1, in which FIG. 6 is a front view, FIG. 7 is a section view taken along the line A—A of FIG. 6, FIG. 8 is a section view taken along the line B—B of FIG. 6, FIG. 9 is a plane view, and FIG. 10 is a section view taken along the line C—C of FIG. 6;

FIGS. 11 to 14A shows the details of various portions of the screw compressor shown in FIG. 1, in which FIG. 11 is a vertical section view of a capacity control valve, FIG. 12 is a vertical section view of an air cooler, FIG. 13 is a view for explanation of a three-dimensional structure of the air cooler, FIG. 14 is a vertical section view showing a speed increaser and a motor, and FIG. 14A is a cross-sectional view along line A—A of FIG. 14.

DETAILED DESCRIPTION OF THE INVENTION

Figure 1:
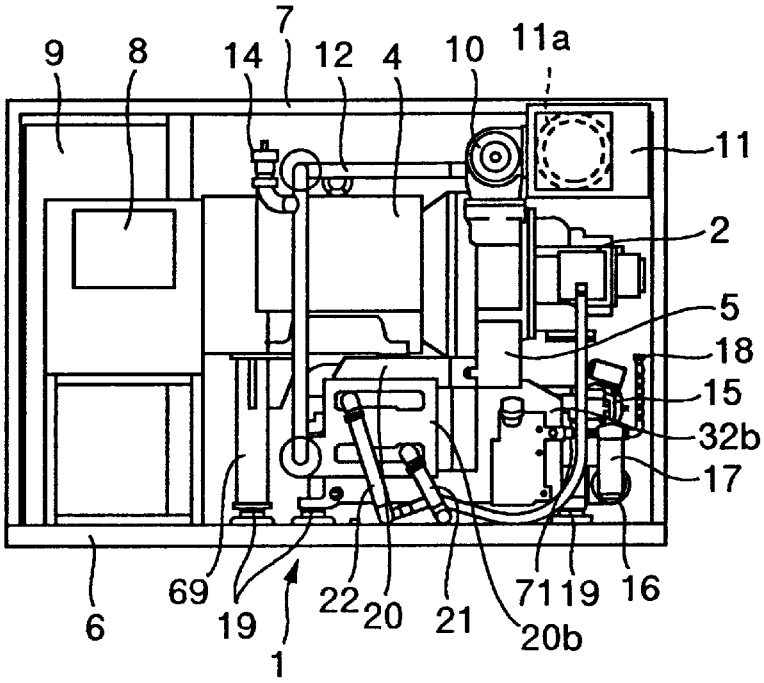
FIG. 1 is a front view of a screw compressor according to the invention.
Figure 2:
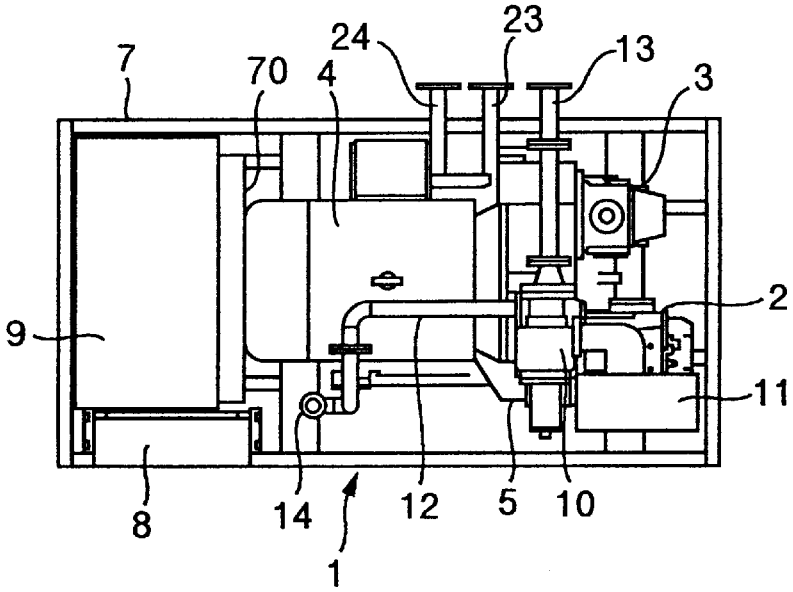
FIG. 2 is a plan view of the compressor.
Figure 3:
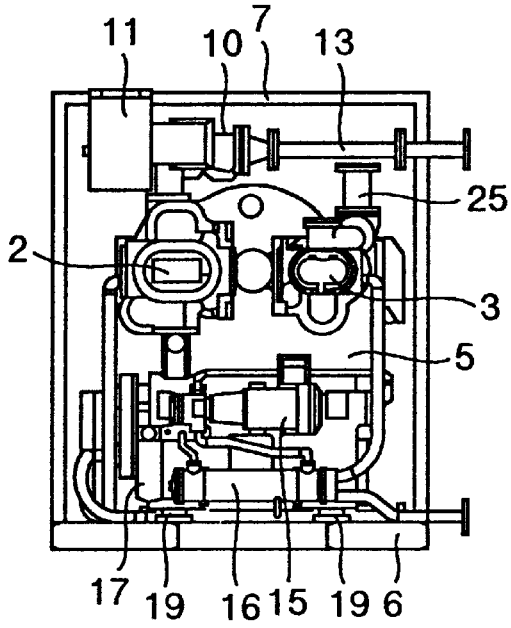
FIG. 3 is a side view the compressor.
Figure 4:
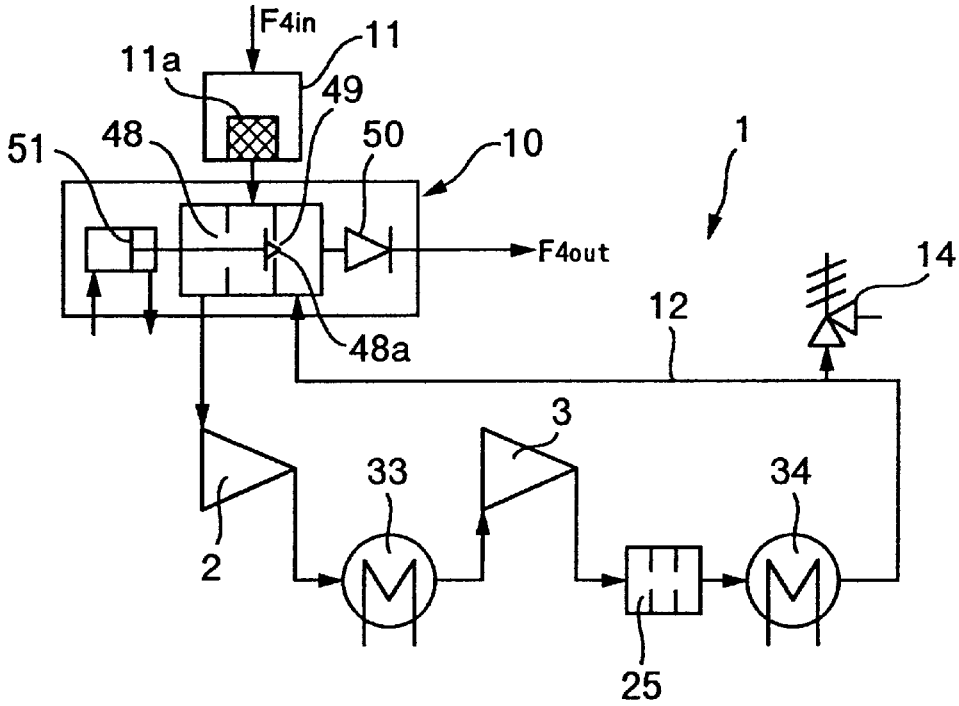
FIGS. 4 and 5 are views for explanation the operation of the screw compressor of FIG. 1.
Figure 5:
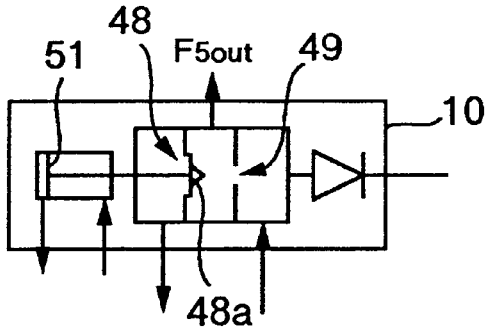
Figure 15:
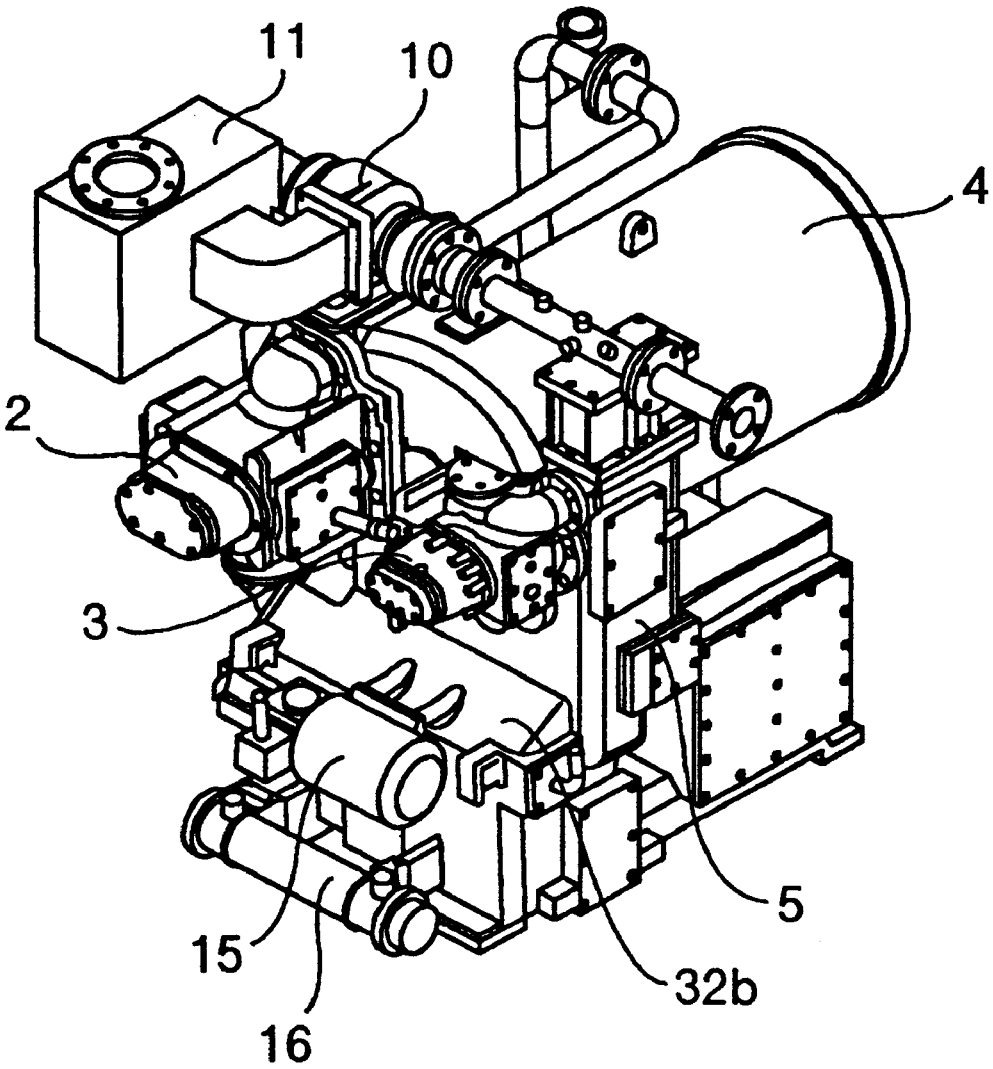
FIG. 15 is a perspective view of the screw compressor.

An embodiment of a package-type screw compressor according to the invention will now be described with reference to the drawings. FIGS. 1 to 3 show the appearance of the screw compressor according to the invention, in which FIG. 1 is a front view, FIG. 2 is a plan view, and FIG. 3 is a right side view. FIGS. 4 and 5 are views for explanation of the flow of working air in the screw compressor of FIG. 1. FIG. 15 is a perspective view of the package-type screw compressor of FIG. 1 with a soundproof cover removed.

The screw compressor 1 of this embodiment is a two-stage compressor comprising a low-pressure stage (first stage) compressor 2 and a high-pressure stage (second stage) compressor 3, and this screw compressor 1 is a so-called dry screw compressor in which a meshing portion of a screw rotor is not positively lubricated. Gas to be treated by this screw compressor is the air. A discharge pressure of this screw compressor 1 (a discharge pressure of the second stage compressor) is about 0.7–1.0 MPa (gauge pressure), and a discharge pressure of the low-pressure stage is about 0.2–0.35 MPa. The compressed air is needed and consumed mainly by plants and factories, and is used mostly as an air source in such plants of ordinary industries.

The low-pressure stage compressor 2 and the high-pressure stage compressor 3 are fastened by bolts to a speed increaser casing 5 at compressor-mounting flanges formed on its side surface. Four legs of the speed increaser casing 5 are fixed to a base 6 through vibration-insulating rubber 19. In each of the two compressors 2 and 3, a pair of male and female screw rotors are contained in a compressor casing. A rotation shaft of each rotor is disposed at the same level or height as that of a rotation shaft of an electric motor 4, and these rotation shafts are disposed horizontally. A bull gear is fitted on an end of the shaft of the motor 4, and pinion gears, mounted respectively on one ends of the shafts of the male rotors of the low-pressure and high-pressure stage compressors 2 and 3, are in mesh with this bull gear. The female rotors of the two compressors 2 and 3 are in mesh with respective timing gears mounted on the other ends of the shafts of the male rotors of the two compressors 2 and 3, so that the pair of male and female rotors of each of the two compressors 2 and 3 rotates in a synchronizing manner. Therefore, the bull gear mounted on the motor 4, and the pinion gears mounted on the male rotors of the respective stage compressors are housed in the speed increaser casing 5. A lower portion of the speed increaser casing 5 is formed in a L-shape in cross section, and is used as an oil tank.

The electric motor 4 is disposed on that side of the speed increaser casing 5 facing away from the two compressors 2 and 3. In FIGS. 1 and 2, a motor intake duct 70 for introducing the cooling air into the motor 4 is provided on a left side of the motor 4, and a starter panel 9 for activating the package-type screw compressor 1 is provided on a left side of this motor cooling air intake duct 70. A control panel 8, which will be described later in detail, is provided on a front surface of the starter panel 9. The starter panel and the control panel, if necessary, may be provided as separate units.

The two compressors 2 and 3 and the motor 4 are disposed at a predetermined height or level from the base 6. In other words, a space, in which other parts can be arranged, is provided below the two compressors 2 and 3 and the motor 4. In this embodiment, an intercooler and an aftercooler for cooling the compressed air, increased in pressure and temperature by the two compressors 2 and 3, are provided in the space below the motor 4, and the space below the two compressors 2 and 3 forms a part of the oil tank 32*b* as described above.

In FIG. 1, an oil cooler 16, communicating with the oil tank 32*b*, is installed on a lower portion of a right side of the oil tank 32*b*, and an oil pump 15, communicating with the oil tank 32*b*, is installed on an intermediate portion of the right side of the oil tank 32*b*, with their longitudinal axes being oriented in a direction substantially perpendicular to the rotor shafts of the compressors. Lubricating oil to be supplied to various portions of the compressors 2 and 3 is fed from the oil tank, provided at the lower portion of the speed increaser casing 5, to the oil pump 15 via a primary strainer. Then, the lubricating oil is cooled by the oil cooler 16, and after the cooling, a part of the lubricating oil is fed to a relief valve and a solenoid valve via a branch portion provided in the speed increaser casing 5. The remainder of the lubricating oil is regulated in pressure by an orifice 71, and is fed to a manifold 18 via an oil filter 17. Then, the lubricating oil is distributed from the manifold 18 to the various portions of the compressors 2 and 3.

The intercooler and the aftercooler are disposed adjacent to each other, and a casing 20 for them is of an integral construction. Further, the cooler casing 20 is formed integrally with the speed increaser casing 5, and this integral casing is made of a casting or molding. A heat transfer tube is provided within the cooler casing 20. The working air, compressed by the compressors 2 and 3, flows around this heat transfer tube. A flow passage, connecting the compressors 2 and 3 to the oil cooler, is formed in the integrally-cast casing. Therefore, the interior of the speed increaser casing 5 is divided by partition walls. Cooling water for cooling the compressed air is fed into the heat transfer tube in the cooler casing 20. Therefore, a water feed pipe 21 and a water discharge pipe 22 are fastened by screws to a flange plate 20*b* serving as a lid of the cooler casing 20.

The motor 4 is a totally-enclosed, fan-cooled induction motor, and this motor 4 is connected to the speed increaser casing 5 through a flange to be supported thereon in a cantilever manner. The flange connection portion is formed in a spigot-shape so that a gear transmission portion can easily assembled with a predetermined precision. Further, the motor 4 is supported at its cantilever end by one or two supports 69, thereby reducing the burden on the spigot portion. Vibration-insulating rubber 19 is interposed between the support 69 and the base 6, thereby preventing vibrations of the motor 4 from being transmitted to the interior of the package.

A capacity control valve 10 is installed above the speed increaser casing 5 and adjacent to the low-pressure stage compressor 2. A working air intake duct 11, containing an intake filter 11*a*, is mounted on the capacity control valve 10. As shown in FIG. 4, an intake throttle valve 48, a blow-off valve 49, and a check valve 50 are equipped within the capacity control valve 10. The intake throttle valve 48 and the blow-off valve 49 are opened and closed when an intake throttle valve member 48*a,* mounted on a distal end of a piston 51, is moved in an axial direction.

The aftercooler 34 is connected to the upstream side of the check valve 50 of the capacity control valve 10 through a discharge pipe 12 of steel. A discharge pipe 13, comprising a steel pipe, is also connected to the secondary side of the check valve 50. The distal end portion of this discharge pipe 13 extends through a compressor soundproof cover 7 to the exterior of the package, and is connected to a pipe of the consumer. A safety valve 14 is provided on an intermediate portion of the discharge pipe 12. This safety valve 14 may be disposed downstream of the check valve. A discharge silencer 25 is provided above the speed increaser casing 5 and adjacent to the high-pressure stage compressor 3. The discharge air, compressed to a high pressure by the high-pressure stage compressor 3, is introduced into the discharge silencer 25.

After the various elements of the screw compressor 1 are thus mounted on the base 6 and the casing 20 of an integral construction, they are covered with the soundproof cover 7, having a noise absorbing material (e.g. glass wool) affixed to inner surfaces thereof, and as a result the package-type screw compressor of a rectangular parallelepiped shape is formed. A cooling air intake opening for cooling the motor 4 is formed through the soundproof cover 7 serving as a top plate. An external fan is mounted on the end of the shaft of the motor 4, and when this fan is rotated, the cooling air is taken in through the cooling air intake opening and fed to the motor 4 via the motor intake duct 70. An exhaust opening is also formed through the top plate of the soundproof cover 7, and this exhaust opening is opposite to a position where the motor 4 is mounted on the speed increaser casing 5.

In this embodiment, that side of the package-type screw compressor 1, on which an operation panel of the control panel 8 is disposed, is the front side. The various equipment is so arranged that the daily inspection and the maintenance, such as the removal of the intake filter ha, the exchange of an oil element of the oil filter 17, the cleaning of heat-transfer tubes, which form the intercooler and the aftercooler, the replenishment of the lubricating oil and the confirmation of the oil level, can be carried out only from the front side. A cooling water main pipe 23 for supplying the cooling water into the package, a cooling water main pipe 24 for discharging the cooling water to the exterior of the package, and the discharge pipe 13 for supplying the compressed air, which has been discharged from the high-pressure stage compressor, to the consumer can be flange-connected at the rear side of the package.

The flow of the working gas in the package-type screw compressor thus constructed will be described with reference to FIGS. 4 and 5. During a normal on-load operation, the atmosphere (F4in) is sucked, as the working air of the screw compressor, into the intake filter 11*a* in the intake duct 11. After dust and dirt are removed from the air by the intake filter 11*a,* the air is fed to the low-pressure stage compressor 2 via the capacity control valve 10. In the low-pressure stage compressor 2, the air is compressed to a pressure of about 0.25 MPa (gauge pressure), while rising to a temperature of about 150° C. Then, the air is cooled to about 40° C. by the intercooler 33, and is fed to the high-pressure stage compressor 3.

The working air discharged from the high-pressure stage compressor 3 has raised to a pressure of about 0.7–1.0 MPa (gauge pressure). The discharge temperature at that time is about 150–200° C. The working air, which has been compressed by the high-pressure stage compressor 3, is reduced in sound while it passes through the discharge silencer 25. Then, the air is cooled to about 30–40° C. by the aftercooler 34. Thus cooled working gas of high pressure is fed to a plant equipment of the consumer through the check valve 50 provided in the capacity control valve 10.

When the screw compressor is switched to an unload operation as shown in FIG. 5, the piston 51 of the capacity control valve 10 is moved to throttle the intake throttle valve 48. At the same time, the blow-off valve 49 is opened, the pressurized air in the high-pressure stage compressor 3 flows back through the intake duct 11, and the compressed air is released to the atmosphere (F5out). During the unload operation, as the throttle valve 48 is throttled, the intake pressure of the low-pressure stage compressor 2 is kept at a vacuum of about 0.01 MPa. The discharge pressure of the high-pressure stage compressor 3 is about 0.1 MPa which is slightly higher than the atmospheric pressure.

Figure 6:
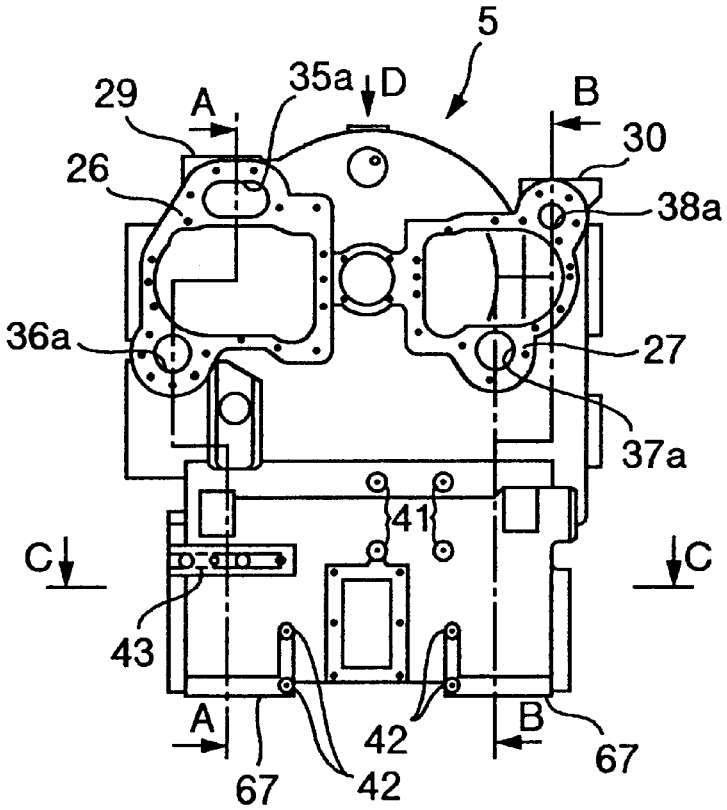
Figure 7:
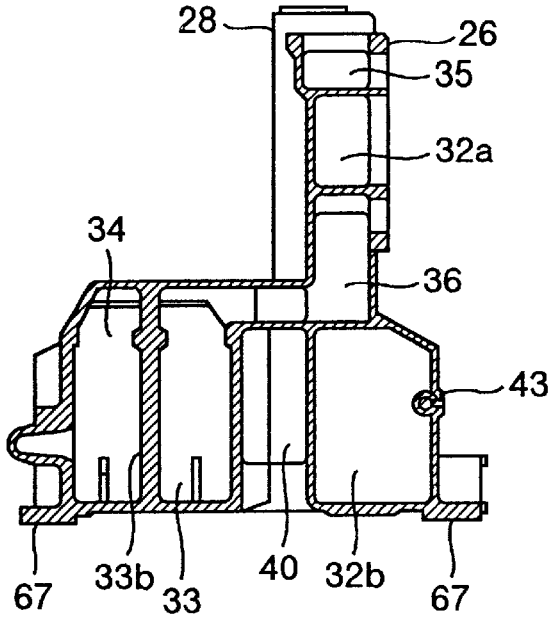
Figure 8:
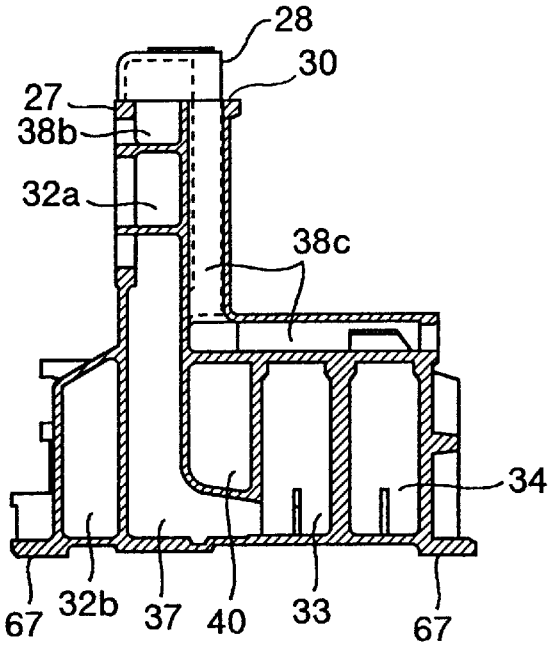
Figure 9:
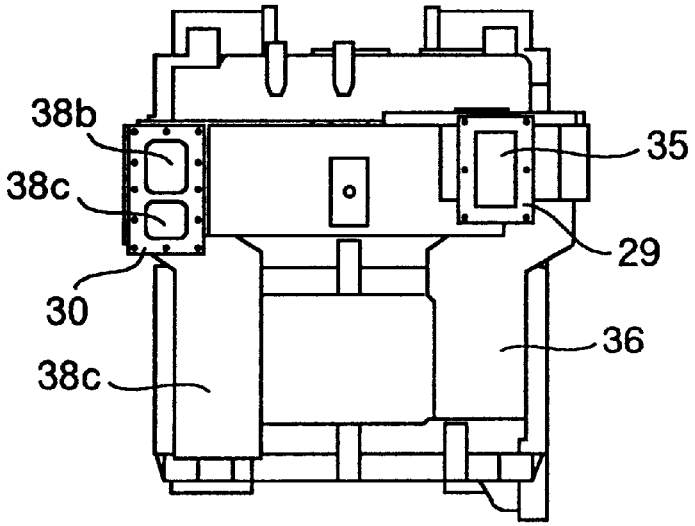
Figure 10:
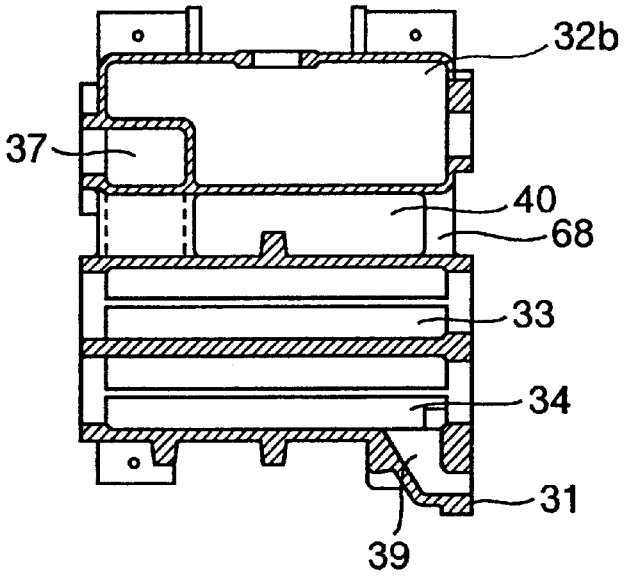

Then, the details of the speed increaser casing 5, used in the above embodiment, will be described with reference to FIGS. 6 to 10. FIG. 6 is a front view of the speed increaser casing 5, FIG. 7 is a section view taken along the line A—A of FIG. 6, and FIG. 8 is a section view taken along the line B—B of FIG. 6. FIG. 9 is a view of the speed increaser casing 5 as seen in a direction of arrow D of FIG. 6, and FIG. 10 is a section view taken along the line C—C of FIG. 6.

A compressor-mounting flange 26 for mount of the low-pressure stage compressor 2 and the compressor-mounting flange 27 for mount of the high-pressure stage compressor 3 are formed on the front side of the speed increaser casing 5. Ports for connection to air passages in the compressors 2 and 3 are formed in the surfaces of the flanges 26, 27 for mount of the compressors 2, 3. Air passages for communication with the two compressors 2 and 3 are formed within the speed increaser casing 5.

More specifically, in FIG. 9, the first stage intake air, introduced via the capacity control valve (not shown) mounted on a capacity control valve-mounting flange 29, is fed to the first stage compressor 2 through the first stage intake passage 35. The discharge air from the first stage compressor 2 is introduced to the intercooler 33 via a first stage discharge passage 36. Similarly, the air, cooled by the intercooler 33, is fed to the second stage compressor 3 via a second stage intake passage 37. The discharge air from the second stage compressor 3 is introduced to the discharge silencer 25 (not shown) via a second stage discharge passage 38*b*. The compressed air from the discharge silencer 25 is introduced to the aftercooler 34 (not shown) via a second stage discharge passage 38. The compressed air is cooled by the aftercooler 34, and then is fed to the consumer via an aftercooler discharge passage 39 and the check valve in the capacity control valve. Thus, the passages, through which the working air flows between the speed increase casing 5 and the constituent elements of the oil-free screw compressor connected to this casing, are formed in the speed increaser casing 5.

As shown in FIG. 6, a first stage intake port 35*a*, communicating with the first stage intake passage 35, and a first stage discharge port 36*a*, communicating with the first stage discharge passage 36, are formed in the first stage compressor-mounting flange 26. Similarly, a second stage intake port 37*a*, communicating with the second stage intake passage 37, and a second stage discharge port 38*a*, communicating with the second stage discharge passages 38*b* and 38*c*, are formed in the second stage compressor-mounting flange 27. As shown in FIGS. 7 and 8, an upper portion 32*a* of the speed increaser casing 5 serves to accommodate the bull gear, mounted on the end of the shaft of the motor 4, and the pinion gears mounted respectively on the ends of the shafts of the male rotors of the two compressors 2 and 3. As described above, the oil tank 32*b* is formed at the lower portion of this speed increaser casing 5. Naturally, the air flowing through the coolers 33 and 34 is not introduced to the oil tank 32*b*.

The intercooler 33 and the aftercooler 34 are integrally formed with each other with a space 40 formed therebetween to provide the cooler casing portion, and this cooler casing portion is disposed aside the oil tank 32*b* on that side of the L-shaped speed increaser casing 5 on which the motor is mounted. Only a partition wall 33*b* is formed between the two coolers 33 and 34. These coolers 33 and 34 are connected to the oil tank 32*b* by the first stage discharge passage 36, the second stage intake passage 37, the second stage discharge passage 38 and a rib 68, and thus formed is the integral casing in which the two coolers are united with the speed increaser casing 5.

Figure 13:
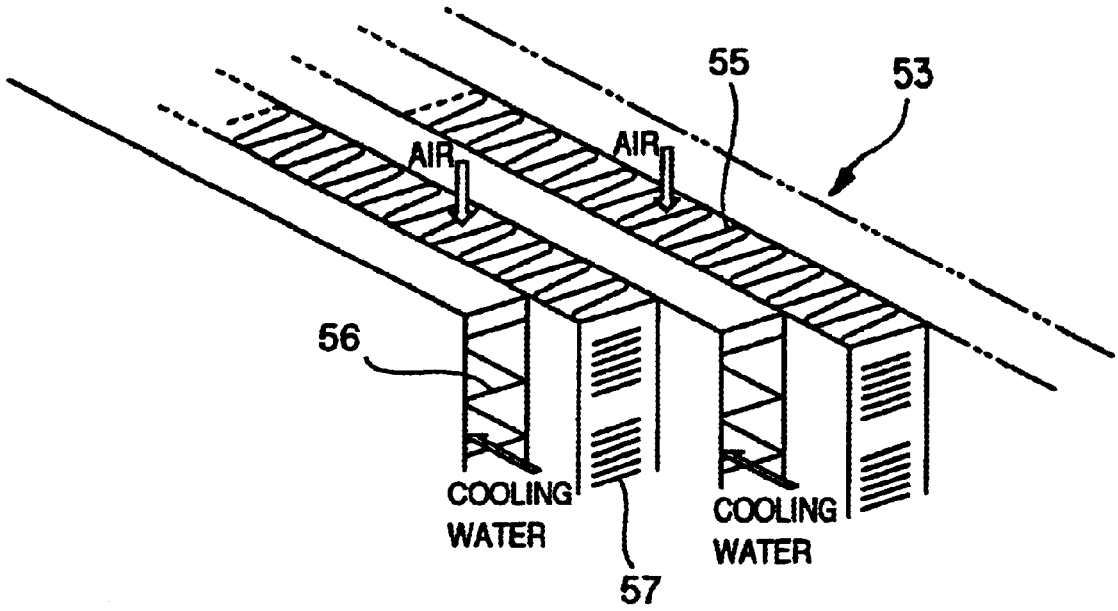

A cooler nest of a heat exchanger, shown in detail in FIG. 13, is inserted in each of the intercooler 33 and the aftercooler 34. The air discharged from each of the compressors 2 and 3 flows into the cooler 33, 34 from the upper side and effects heat exchange with cooling water, which flows through passages of a rectangular cross-section, during the time when the air passes through the cooler nests in the coolers 33 and 34. More specifically, in the case of the intercooler 33, the compressed air, discharged at a discharge temperature of about 150° C. from the low-pressure stage compressor 2, is cooled to about 40° C. and fed to the high-pressure stage compressor 3.

When the compressed air is cooled by the intercooler 33 and the aftercooler 34, steam is condensed to produce drain. The drain, produced in the intercooler 33, drops onto the lower portion of the cooler 33. Then, the drain is discharged to the exterior via a bottom portion of the second stage intake passage 37. If the cross-sectional area of the second stage intake passage 37 is increased so as to sufficiently reduce the flow velocity of the air, the amount of drain mist, carried by the flow and introduced into the high-pressure stage compressor 3, can be reduced.

Mounting seats 41, 42 for mount of the oil pump 15 and the oil cooler 16 are formed on the outer surface of the oil tank 32*b* of the speed increaser casing 5. This is for the purpose of mounting the auxiliary equipments directly on the speed increaser casing 5. A manifold 43 is formed on the oil tank portion to divide and supply lubricating oil to passages for leading the lubricating oil to the portions to be lubricated, and also to the solenoid valve, the relief valve and so on. Since the manifold 43 is formed on the speed increaser casing 5, the oil feed pipes, the oil filter and so on (not shown) can be easily fixed. The manifold 43 is located at a level higher than the lubricating oil level so that the lubricating oil will not flow out of the oil tank 32*a* when replacing the oil element of the oil filter 17.

In the intercooler 33 and the aftercooler 34 of this embodiment, the compressed air flows outside of the heat transfer tube while the cooling water flows in the heat transfer tube. The reason for this is that dirt, which is liable to deposit on a flow passage portion for the cooling water, can be easily removed. In conventional constructions, a shell-and-tube type heat exchanger has been used in a cooler portion such as an intercooler and an aftercooler, which is adapted to make air flow in a tube and to make cooling water flow outside of the tube. In this case, the heat exchanger of a large size is required for increasing the heat exchange ability and the maintenance ability, and besides when cleaning the heat exchanger, the whole of the heat exchanger must be removed.

Although this embodiment has an advantage that such disadvantages of the conventional construction can be overcome, there is encountered another problem that the cooler casing is heated by the compressed air, since the air flows outside of the tube while the cooling water flows in the tube. In this embodiment, the following measures are taken in order to solve this problem.

The casing inner surface of the cooler portion is in contact with the working air of the screw compressor. The air, passing through the cooler nests in the intercooler 33 and the aftercooler 34, flows vertically from the upper side toward the lower side in each of the coolers 33 and 34. Therefore, the upper portion of each cooler 33, 34 becomes high in temperature while the lower portion thereof is low in temperature. The discharge air, discharged at a temperature of about 150° C. from the low-pressure stage compressor 2, flows into the intercooler 33. As a result, the upper portion of the casing of the intercooler 33 rises to a surface temperature slightly below the temperature of the discharge air. The upper portion of the casing of the aftercooler 34 is heated to about 200° C. which is equal to the temperature of the discharge air discharged from the high-pressure stage compressor 3.

The casing is heated by the discharge air discharged from each of the low-pressure stage compressor 2 and the high-pressure stage compressor 3. At this time, the casing is subjected to thermal expansion corresponding to the product of a thermal expansion coefficient (cast iron: $11\times10^6$ [1/° C.]), a length (mm) and a temperature change (° C.). As a result, considerable thermal expansion develops in the cooler casing in its longitudinal direction which is the direction of insertion of the cooler nest. Therefore, in this embodiment, each cooler nest is supported in a cantilever manner on a flange portion formed on the front side of the screw compressor. With this construction, even when the cooler casing is thermally deformed in the longitudinal direction, only the flange portion is displaced, and therefore a thermal stress will not act on the cooler nests, thus improving the reliability of the cooler nests.

Thus, the reliability of the cooler nests can be improved. However, when the cooler casing is thermally deformed, this thermal deformation affects the various portions of the screw compressor. In the screw compressor, the coolers 33 and 34 are connected to the discharge port or the intake port of the compressors 2 and 3 via the air passages, and these air passages suppress the thermal expansion of the cooler casing. At this time, the air passages are thermally deformed. In the conventional constructions, as there have been used the coolers of the tube-inside air (tube-outside water) type, even when the compressors arranged in stages are connected to the coolers by pipes and a flange portion is used to this end, the temperature rise of the cooler casing is small, and therefore the thermal expansion thereof is small, so that there is no possibility of leakage due to the thermal deformation.

However, when using coolers of tube-inside water (tube-outside air) type, there is a possibility that the air leaks from a flange surface for the reasons described above. Therefore, in the present invention, the intake air passages and the discharge air passages for the two compressors 2 and 3 are integrally formed in the cooler casing. With this construction, even when the coolers are thermally deformed, the air will not leak from the flange surface.

The casing is formed into a compact, integral construction by casting so as to reduce the number of the component parts, and in this connection it is desirable to further unite this integral cooler casing with the gear casing. However, if the cooler casing is formed integrally with the gear casing, there is a possibility that the gear casing will be deformed by the thermal deformation of the cooler casing and excessive thermal stresses will act on those portions around openings formed at various positions of the integral casing.

The amount of thermal deformation developing in the cooler casing depends on the length and temperature change of the cooler portion. Therefore, the cooler length is limited to a value really required for the cooler so as to reduce the expected thermal deformation amount. Besides, the rigidity of connection between the cooler casing and the gear casing is lowered so that the thermal deformation of the cooler casing will not be transmitted to the gear casing. To this end, the cooler casing is not directly mounted in the gear casing or on the side surface of the gear casing, but is connected through air passages. With this construction, the cooler casing and the gear casing are spaced from each other, and the adverse effects of the thermal deformation of the cooler casing are prevented from being directly transmitted to the gear casing. The distance between the cooler casing and the gear casing depends on the rigidities of the gear casing, the air passages and the cooler casing. In this embodiment, a distance of 150 mm is provided, thereby preventing the gear casing from being adversely affected by the thermal deformation of the cooler portion.

Since the high-pressure stage compressor 3 is higher in discharge temperature than the low-pressure stage compressor 2, the thermal deformation of the aftercooler 34 is larger than that of the intercooler 33. Therefore, in this embodiment, in order to reduce the effects of the thermal deformation of the coolers 33 and 34 on the gear casing to the minimum, the intercooler is disposed nearer to the gear casing while the aftercooler is situated remoter from the gear casing.

As described above, the use of the coolers of the tube-outside air type causes the temperature of the cooler portion to rise higher as compared with the conventional construction, and the various portions of the screw compressor are affected by the thermal deformation. According to the invention, however, the cooler portion and the gear box portion are spaced from each other, and they are integrally connected to each other through the air passages, and disadvantages due to the thermal deformation, such as the increased thermal stresses and an air leakage at the pipe connection portions, can be prevented.

Figure 11:
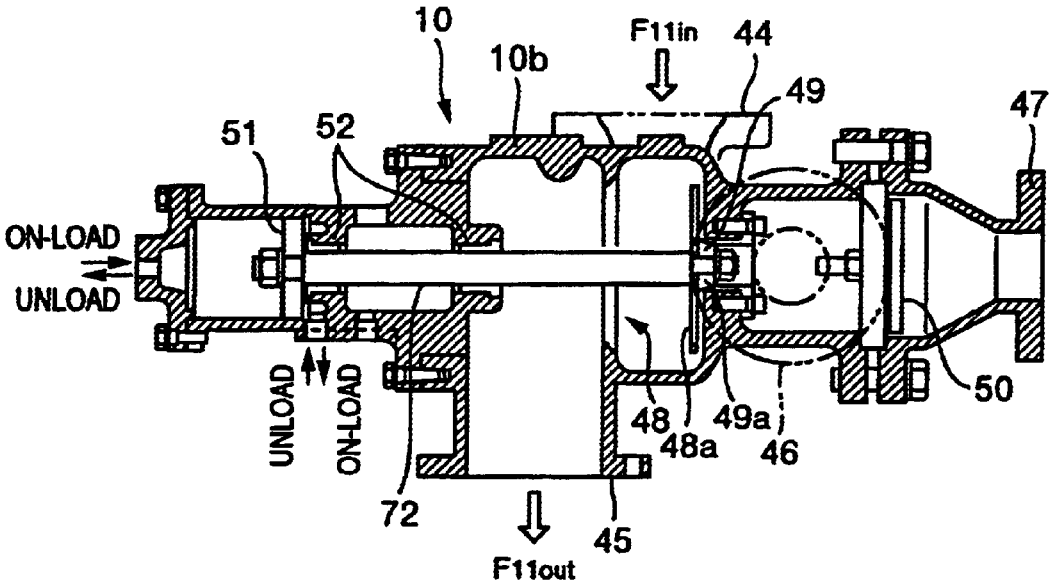

One example of the capacity control valve used in the screw compressor of FIG. 1 is in vertical cross-section shown in FIG. 11. The capacity control valve 10 shown in FIG. 11 is provided between the intake filter 11*a* and the low-pressure stage compressor 2 as schematically shown in FIG. 4. A compressor-connecting flange 45 for causing the intake air (F11out) to flow into the low-pressure stage compressor 2 is formed at a lower portion of the capacity control valve 10. This flange 45 is flange-connected to the capacity control valve-mounting flange 29 (see FIG. 9) of the first stage intake passage 35 formed in the speed increaser casing 5. An intake duct-mounting flange 44 for introducing the ambient air (F11in) into the capacity control valve 10 is formed on an upper portion of the capacity control valve 10. This flange 44 is flange-connected to the intake duct 11 containing the intake filter 11*a*. A flange 47 is formed on the right side of the capacity control valve 10, and a flange 46 is formed on the front side of the capacity control valve 10. The second stage discharge pipe, provided downstream of the aftercooler, is connected to the flange 46, and a final discharge pipe of the screw compressor is connected to the flange 47.

The intake throttle valve 48, the blow-off valve 49 and the check valve 50 are housed in a housing 10*b* of the capacity control valve 10. A valve member 48*a* of the intake throttle valve 48 and a valve member 49*a* of the blow-off valve 49 are fixedly mounted on a distal end portion of a shaft 72. The shaft 72 is slidably supported by bearings 52 mounted on the housing 10*b*. The piston 51 is mounted on that end of the shaft 72 remote from the valve members 48*a* and 49*a*, and a hydraulic pressure is supplied to this piston 51.

The intake throttle valve 48 and the blow-off valve 49 are operated in an interlocking manner. When the screw compressor is switched from the unload operation to the on-load operation, the intake throttle valve 48 is opened while the blow-off valve 49 is closed. In contrast, when the screw compressor is switched from the on-load operation to the unload operation, the intake throttle valve 48 is closed while the blow-off valve 49 is opened.

The second stage discharge air, which is discharged from the aftercooler 34 and has been cooled to an ordinary temperature, is introduced to the primary side of the blow-off valve 49. When the blow-off valve 49 is opened in the unload operation, the pressurized air in an amount corresponding to the capacities of the aftercooler 34 and the second stage discharge pipe portion, is released into a space which is between the secondary side of the blow-off valve 49 and the primary side of the intake throttle valve 48. Then, the air flows back through the intake filter 11*a*, and is blown off to the exterior of the screw compressor via the intake duct 11. As the blow-off air is returned to the intake portion of the screw compressor and the intake duct 11 serves as an intake silencer, there is no need to provide a blow-off silencer. Besides, since the blow-off air flow back through the intake filter 11*a*, there is achieved an effect that dust, dirt and so on deposited on the intake filter 11*a* are blow off.

The second stage discharge air, which is discharged from the aftercooler 34 and has been cooled to the ordinary temperature, is fed also to the primary side of the check valve 50. This second stage discharge air, as having been cooled to the ordinary temperature, is lower in volume flow rate as compared with the case where the second stage discharge air is fed while being kept at the temperature when discharged from the high-pressure stage compressor. Therefore, the check valve can be reduced in size.

Figure 12:
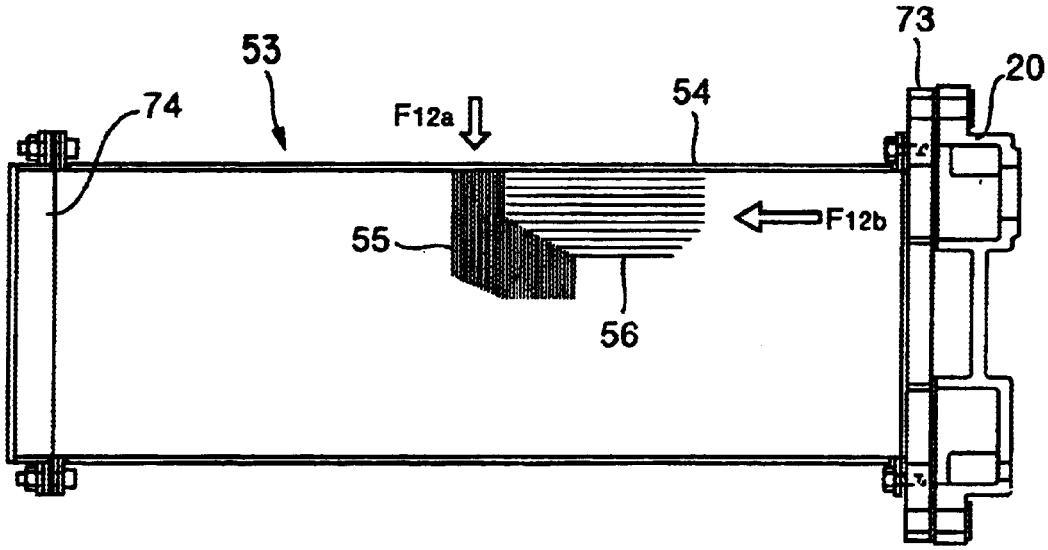

Next, the intercooler and the aftercooler used in the screw compressor of FIG. 1 will be described with reference to FIGS. 12 and 13. The intercooler 33 and the aftercooler 34 have a similar construction. In these coolers 33 and 34, the cooler nest and the flange portion will be collectively referred to as "air cooler". FIG. 12 is a vertical cross-sectional view of the air cooler, and FIG. 13 is a perspective view of a portion of the air cooler of FIG. 12.

The air cooler 53 includes a water chamber casing 20, a pressure-proof tube plate 73, the cooler nest 54, a return header 74, etc. The air cooler 53 in an assembled condition is inserted into the cooler casing portion of the speed increaser casing 5, thus forming the intercooler and the aftercooler. Since the intercooler 33 and the aftercooler 34 are disposed adjacent to each other, the supply and discharge of water relative to the two coolers 33 and 34 are collectively effected in the water chamber casing 20. The connection to the cooling water main pipe (in which industrial water flows) is made at one point, and also the connection to a discharge pipe is made at one point.

Cooling water passages in the cooler nest 54 are defined by rectangular wave-like inner fins 56 extending in a right-left direction in FIG. 12. The passages are of a four-path construction. Air passages are defined by an accordion-like corrugated fins 55 extending in an upward-downward direction in FIG. 12. The air passages have only one path extending from the upper side to the lower side. In the whole of the cooler nest 54, the inner fins 56, forming the cooling water passages, are arranged in four layers, the corrugated fins 55, forming the air passages, are arranged in three layers, and these are alternately stacked together. The fins are joined together by brazing. The number of these fin layers is not limited to that described above, and may be increased so far as the available space allows.

The air cooler 53 is a so-called corrugated fin tube-type, and the cooling water passage side is closed while the air passage side is open. In order to enhance the efficiency of heat transfer, it is necessary to divide a space around the nest, inserted in the casing, into a high-temperature side and a low temperature side. In this embodiment, a seal plate (not shown) is held against the side surface of the casing to separate the high-temperature side at an upper portion of the nest from the low-temperature side at a lower portion of the nest.

Figure 14:
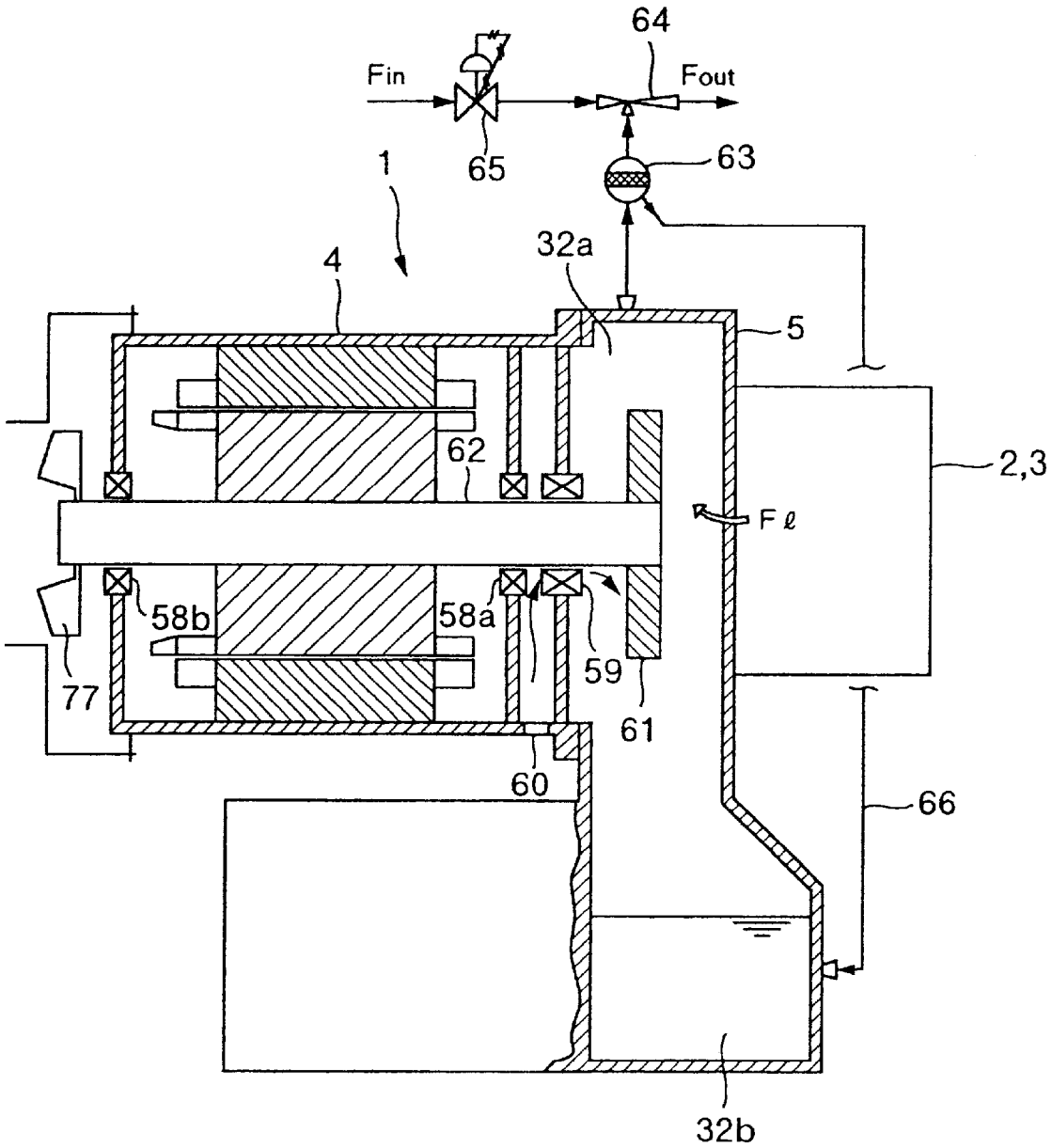
Figure 14A:
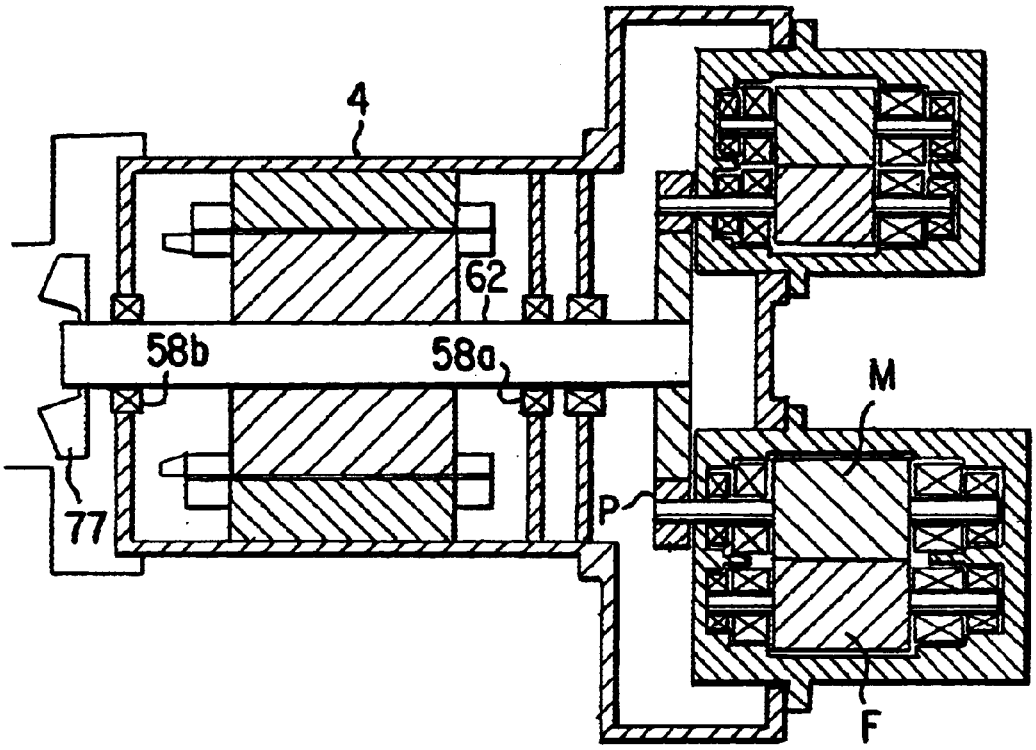

FIGS. 14 and 14A show the details of the electric motor portion of the screw compressor of FIG. 1 in cross section, including the male and female rotors M and F, respectively, and the pinion P mounted on an end of the shaft of the male rotor M. The electric motor 4 is of the totally-enclosed, fan-cooled type and is of the flange-mounting type. The shaft 62 of the motor 4 is rotatably supported by bearings 58*a* and 58*b*. A fan 77 is directly fitted on one end of the shaft 62, and the bull gear 61 for driving the compressor is directly fitted on the other end of the shaft 62 in overhanging relation to the bearing 58*a*.

The shaft end of each screw rotor of the low-pressure stage and high-pressure stage compressors 2, 3 is sealed by a non-contact seal comprising a carbon ring seal and a screw seal. As a result, the air (Fl) slightly leaks from each of the compressors 2 and 3 into the speed increaser casing 5. Unless this leakage air is sufficiently discharged from the speed increaser casing, the pressure within the casing will increase, and this results in possibilities that the lubricating oil leaks into the motor 4 and that grease flow out from the bearings 58*a* and 58*b* of the motor 4. In order to avoid this disadvantage, it is possible to provide a vent pipe of a sufficiently large diameter on the speed increaser casing 5 for preventing the internal pressure of the speed increaser casing 5 from increasing. With this construction, however, a filter with a large pressure loss can not be used. As a result, there is a possibility that part of oil fume within the casing will be discharged to the exterior.

Therefore, in this embodiment, the air is forcibly sucked from the interior of the speed increaser casing 5, and is discharged (Fout) to the ambient atmosphere so as to keep the internal pressure of the oil tank at a negative pressure. More specifically, an ejector 64 is connected to the speed increaser casing 5. This ejector 64 is driven by the air (Fin) introduced from the second stage discharge pipe portion downstream of the check valve 50. An oil fume-separating filter 63 is provided between the speed increaser casing 5 and the ejector 64. With this construction, the oil fume will not be discharged to the exterior, and the internal pressure of the oil tank can be kept at a level several millimeters (water column) lower than the atmospheric pressure.

The drain, separated by the oil fume-separating filter 63, is returned via a pipe 66, connected to this separation filter 63, to that portion of the oil tank 32*b* which is below the surface of the oil held in this tank 32*b*. The discharge air, from downstream of the check valve 50, is used for driving the ejector 64. This is because that the internal pressure of the speed increaser casing 5 can be kept at a negative pressure even in the unload operation of the compressor 1. To this end, the air pressure, required for driving the ejector, is provided by the air pressure on the downstream side of the check valve 50. This drive air pressure does not need to be as high as the second stage discharge pressure in the on-load operation, and therefore the discharge air from the high-pressure stage compressor 3 is decreased by a regulator 65 and is then used.

When the internal pressure of the speed increaser casing 5 is reduced to a negative pressure, there is fear that the air will flow or leak through the bearings 58*a* and 58*b* of the motor 4 into the speed increaser casing 5, causing grease on these bearings to flow out. Therefore, in this embodiment, a shaft seal 59 is provided between the load-side bearing 58*a* of the motor and the bull gear 61. Further, there is formed an atmosphere hole 60 which opens a space between the load-side bearing 58*a* and the shaft seal 59 to the ambient atmosphere. The presence of this atmosphere hole 60 allows, when the internal pressure of the speed increaser casing 5 is reduced to a negative pressure, a very small amount of air to leak into the speed increaser casing 5 through the atmosphere hole 60 and the shaft seal 59. However, the amount of this leakage air is sufficiently small relative to the amount of the air sucked by the ejector, and therefore will not adversely affect the operation of the ejector. The shaft seal 59, provided at the motor 4, comprises an oil-removing labyrinth and a screw seal in combination. When the pressure downstream of the check valve 50 does not yet increase sufficiently as at the time of starting the operation of the compressor 1, the shaft of the motor is sealed by a pumping action of the screw seal of the shaft seal 59.

The embodiment achieves the following advantageous effects.

(1) The casings of the intercooler and the aftercooler are formed integrally with the speed increaser casing, and the number of the component parts is reduced to improve the economy.

(2) The intake passages for feeding gas to the respective stage compressors and the discharge passages for discharging the gas from the respective stage compressors are formed in the speed increaser casing. The respective stage compressors can be mounted directly on the speed increaser casing. The intake ports and the discharge ports for introducing the gas from and to the respective stage compressors are formed in the compressor-mounting surface of the speed increaser casing. Accordingly, the number of the component parts is reduced to improve the economy.

(3) The secondary side of the blow-off valve is connected to the primary side of the capacity control valve, and therefore the number of the component parts is reduced. Besides, the check valve is disposed downstream of the aftercooler, and the check valve can be reduced in size to improve the economy.

(4) The cooler of an integral construction includes the intercooler and the aftercooler, and the compressed air flows outside of the tubes of each cooler while the cooling water flows in the tubes. Therefore, the maintenance ability can be enhanced without lowering the heat transfer efficiency of each cooler. Besides, as the space is provided between the cooler portion and the speed increaser casing, the thermal deformation of the cooler portion can be prevented from adversely affecting the speed increaser casing.

(5) The lower portion of the speed increaser casing is used as the oil tank, and the cooler portion is located below the electric motor. Accordingly, a region below the respective stage compressors can be utilized for mount of the oil pump and the oil cooler, and the lubricating oil pipes and the cooling water pipes can be reduced in length.

(6) The ejector device is provided for introducing the air from the interior of the speed increaser casing, and the oil-separating filter is provided between the speed increaser casing and the ejector. Therefore the oil can be recovered relatively inexpensively.

(7) The non-contact shaft seal device, including, the labyrinth seal and the screw seal, is provided between the speed increaser-side bearing of the motor and the bull gear to separate the interior of the speed increaser casing from the internal space of the motor, and the space on that side of the shaft seal device directed to the motor is opened to the ambient atmosphere. Therefore, a complicated shaft seal structure is not necessary.

Although the above embodiment has been described taking the screw compressor comprising the two stage compressors as an example, similar effects can be obtained with respect to a single-stage screw compressor comprising only one stage compressor, in which case the intercooler is naturally unnecessary.

As described above, in the screw compressor of the invention, the speed increaser casing is formed integrally with the cooler casing, and the number of the component parts is reduced, enabling the compact design. Further, the intercooler and the aftercooler of the screw compressor can have the construction in which the cooling water flows in the tubes while the compressed air flows outside the tubes and the maintenance of them can be easily effected.

What is claimed is:

1. A screw compressor comprising: an electric motor having a bull gear mounted on an end of a shaft of said motor; a first stage compressor and a second stage compressor, each including a male rotor having a pinion mounted on an end of a shaft of said male rotor, said pinions of said two compressors being in mesh with said bull gear of said electric motor; a speed creaser casing for accommodating said bull gear and said pinions; an intercooler for cooling air compressed by said first stage compressor; an aftercooler for cooling the air compressed by said second stage compressor; and a casing of said intercooler, a casing of said aftercooler and said speed increaser casing being formed integrally with one another into an integral casing, wherein said integral casing is made of a casting, and said intercooler and said aftercooler each have a cooler nest, in which cooling water flows in tubes of said cooler nest while the compressed air flows outside of the tubes.

2. A screw compressor according to claim 2, wherein flow passages for connecting the respective stage compressors to said intercooler and said aftercooler are formed in said integral casing.

3. A screw compressor according to claim 1, wherein said cooler nest is removably mounted on said integral casing, and said cooler nest can be removed in a direction substantially perpendicular to an axis of rotation of said motor.

4. A screw compressor according to claim 1, further comprising an oil tank portion formed at a lower portion of said speed increaser casing for holding lubrication oil for lubricating said pinions and said bull gear, an oil pump for supplying the lubrication oil, collected in said oil tank portion, to said pinions and said bull gear, and an oil cooler for cooling the lubrication oil, said oil cooler being mounted on said speed increase casing.

5. A screw compressor comprising: an electric motor having a bull gear mounted on an end of a shaft of said motor; a first stage compressor and a second stage compressor, each including a male rotor having a pinion mounted on an end of a shaft of said male rotor, said pinions of said two compressors being in mesh with said bull gear of said electric motor; a speed increaser casing for accommodating said bull gear and said pinions; an intercooler for cooling air compressed by said first stage compressor; an aftercooler for cooling the air compressed by said second stage compressor; and a casing of said intercooler, a casing of said aftercooler and said speed increaser casing being formed integrally with one another into an integral casing, wherein said integral casing has a generally L-shape in cross-section, and said intercooler and said aftercooler are adjacent to each other, and a space is formed between said two coolers and said speed increaser casing to space said two coolers from said speed increaser casing.

6. A screw compressor comprising: a first stage compressor; an intercooler for cooling working air compressed by said first stage compressor; a second stage compressor for compressing the working air cooled by said intercooler; an aftercooler for cooling the working air compressed by said second stage compressor; speed increasing gears for transmitting motive power of an electric motor to the respective stage compressors; and an integral molded casing made of a casting for accommodating said first and second stage compressors, said integral casing including working gas flow passages integrally formed therein through which the working gas sucked into said first stage compressor flows out from said aftercooler wherein said integral casing includes a casing of said intercooler and a casing of said aftercooler, and said intercooler and said aftercooler each have a cooler nest, in which the working air flows outside of tubes of said cooler nest while cooling water flows in the tubes.

7. A screw compressor comprising: a first stage compressor; an intercooler for cooling working air compressed by said first stage compressor; a second stage compressor for compressing the working air cooled by said intercooler; an aftercooler for cooling the working air compressed by said second stage compressor; speed increasing gears for transmitting motive power of an electric motor to the respective stage compressors; and an integral casing for accommodating said first and second stage compressors, said integral casing including working gas flow passages through which the working gas sucked into said first stage compressor flows out from said aftercooler, wherein said integral casing includes a speed increaser casing for accommodating said speed increasing gears, said intercooler and said aftercooler are adjacent to each other, and said coolers are spaced from said speed increaser casing.

8. A screw compressor comprising: an electric motor having a bull gear mounted on an end of a shaft of said motor; a first stage compressor and a second stage compressor, each including a male rotor having a pinion mounted on an end of a shaft of said male rotor, said pinions of said two compressors being in mesh with said bull gear of said electric motor; a speed increaser casing for accommodating said bull gear and said pinions; an intercooler for cooling air compressed by said first stage compressor; an aftercooler for cooling the air compressed by said second stage compressor; and a casing of said intercooler, a casing of said aftercooler and said speed increaser casing being formed integrally with one another into an integral casing further comprising sealing means operatively associated with said motor and said speed increaser casing for retaining a negative pressure in said gear increaser casing wherein during an operation of said screw compressor, interior of said speed increaser casing is kept at a pressure lower than atmospheric pressure.

9. A screw compressor comprising: an electric motor having a bull gear mounted on an end of a shaft of said motor; a first stage compressor and a second stage compressor, each including a male rotor having a pinion mounted on an end of a shaft of said male rotor, said pinions of said two compressors being in mesh with said bull gear of said electric motor; a speed increaser casing for accommodating said bull gear and said pinions; an intercooler for cooling air compressed by said first stage compressor; an aftercooler for cooling the air compressed by said second stage compressor; and a casing of said intercooler, a casing of said aftercooler and said speed increaser casing being formed integrally with one another into an integral casing further comprising sealing means operatively associated with said motor and said speed increaser casing for retaining a negative pressure in said gear increaser casing wherein during an operation of said screw compressor, interior of said speed increaser casing is kept at a pressure lower than atmospheric pressure.

* * * * *